United States Patent [19]

Rieumont

[11] 4,282,669

[45] Aug. 11, 1981

[54] ILLUMINATED PICTURE FRAME

[76] Inventor: Jose Rieumont, 60 E. 34 St., Hialeah, Fla. 33013

[21] Appl. No.: 118,087

[22] Filed: Feb. 4, 1980

[51] Int. Cl.[3] ..... G09F 19/14; A47G 1/06; G09F 11/30; G09F 13/00

[52] U.S. Cl. ..... 40/453; 40/152.2; 40/563; 40/508

[58] Field of Search ..... 40/453, 152.2, 563, 40/437, 438, 508

[56] References Cited

U.S. PATENT DOCUMENTS

| | | | |
|---|---|---|---|
| 729,599 | 6/1903 | Jolly | 40/453 X |
| 1,353,363 | 9/1920 | Simon | 40/453 |
| 1,967,658 | 7/1934 | Buescher et al. | 40/453 |
| 2,529,713 | 11/1950 | Thurston | 40/152.2 X |
| 2,577,982 | 12/1951 | Traum | 40/152.2 |
| 2,847,783 | 8/1958 | Anderson | 40/453 |

*Primary Examiner*—Gene Mancene
*Assistant Examiner*—Michael J. Foycik

[57] ABSTRACT

A decorative display, including a shallow box mounted in a picture frame, a first picture being on the front side of the box rear wall, and which is visible from a directly front direction by the line of sight passing through a grate inside the box, the grate consisting of a series of spaced-apart thin strips, one side of the strips having sections of a second picture, so as to form a composite picture when viewed from an angle, and the other side of the strips being likewise illustrated with sections of a third picture for view from an opposite angle, and the display including electric lamps for the picture illumination. A fourth and fifth picture is provided by a slidable grate over the strips.

1 Claim, 7 Drawing Figures

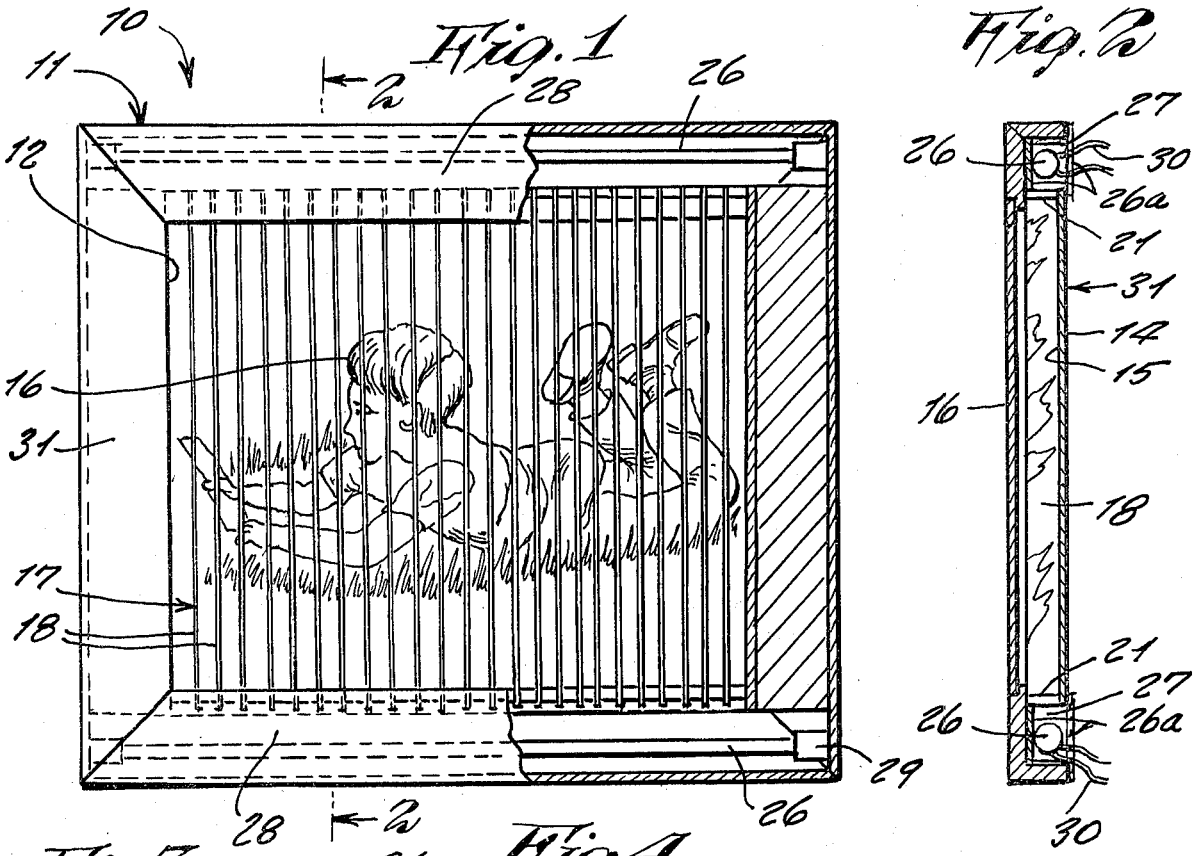
Fig. 1
10
11
12
2
28
26
16
31
17
18
29
26
28
2
Fig. 2
27
26
30
26a
21
31
14
15
16
18
21
27
26
26a
30
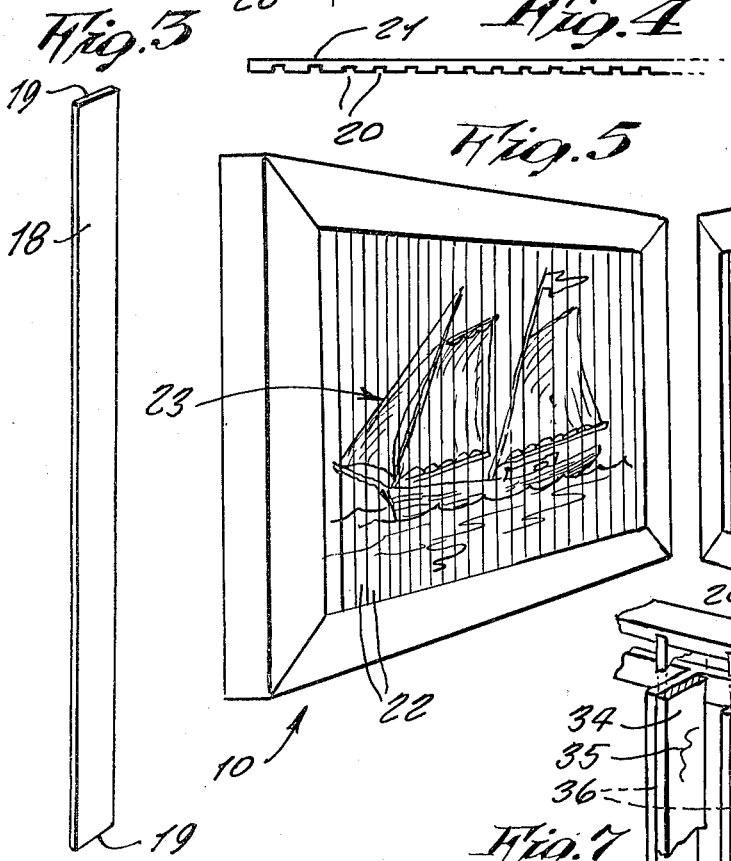
Fig. 3
19
18
19
Fig. 4
21
20
Fig. 5
23
22
10
Fig. 6
25
24
10
Fig. 7
20
21
37
34
35
36
34
35
32
33
17
18
18

ILLUMINATED PICTURE FRAME

This invention relates generally to picture display devices.

A principal object of the present invention is to provide an illuminated picture frame, in which three different full-sized pictures can each be individually displayed, according to an observer's position, whether directly in front thereof or toward either side.

Another object is to provide an illuminated picture frame, which, in a modified design thereof, additionally displays selectively yet another two full-sized pictures, so as to total five pictures.

Other objects are to provide an illuminated picture frame, which is simple in design, inexpensive to manufacture, rugged in construction, easy to use, and efficient in operation.

These, and other objects, will be readily evident, upon a study of the following specification, and the accompanying drawing, wherein:

FIG. 1 is a directly front view of the illuminated picture frame, shown partly in cross-section, and one of the pictures being visible;

FIG. 2 is a side cross-sectional view, taken on line 2—2 of FIG. 1;

FIG. 3 is a perspective view of one of the slats or strips that form a grate of the device;

FIG. 4 is a front view of a transparent plexiglass cover used on top of the slatted grate of the invention;

FIG. 5 is a perspective view of the device, as viewed from the left side, so as to show a different picture;

FIG. 6 is a perspective view of the device, as viewed from the right side, so as to show still another picture, and FIG. 7 is a fragmentary perspective view of a modified construction of the slatted grate, so as to change selectively the pictures that are visible from the left and right sides.

Referring now to the drawing in greater detail, the reference numberal 10 represents an illuminated picture frame, according to the present invention, wherein there is a rectangular wooden frame 11 around a central opening 12, behind which a shallow box 13 closes a rear thereof. The front side of the box rear wall 14 carries a picture 15.

A transparent glass pane 16, in the frame opening, closes the front side of the box.

A slatted grate 17, inside the box, comprises a plurality of equally spaced-apart slats or strips 18, made of a thin material, such as sheet metal, wood, stiff paper or the like, extends the full height of the box, the upper and lower edges 19 of the slats being inserted into notches 20 of upper and lower transparent walls 21 of the box, for retaining the slats in position. The slats extend the full depth of the box.

A left side of each slat carries a strip portion 22 of a composite picture 23, that is together formed by all the slats, and which is visible from an angularly left direction by an observer. A right side of each slat likewise carries a strip portion 24 of a composite picture 25, visible from angularly right direction.

In the present invention, a horizontally extending fluorescent lamp 26, with reflector **26*a*, is contained in a hollowed chamber 27, of the upper and lower side members 28 of the frame 11. The lamps are fitted in end sockets 29, and electrical wiring 30 therefrom extends either outwardly from the rear of the frame, for connection to an external electric power source, or else to a dry cell battery and switch, contained in chambers provided of the frame left and right side members 31**.

In operative use, it is now evident that illumination from the lamps, through the upper and lower walls 21 of the box, will clearly allow viewing any of the pictures.

In a modified design 32 of the invention, shown in FIG. 7, the grate 17 additionally includes a secondary grate 33 interfitted therein, wherein a slat 34, between each slat 18, is provided with a section 35 of a composite picture on one side, and a section 36 of another composite picture on its other side. The slats are fixedly joined together by a narrow horizontal bar 37 near the upper and lower ends, one bar end extending outward of a side of the frame 11, so as to allow manual shifting of the grate 33 either to the left or right, allowing the slats 34 to abut either sides of slats 18, thus hiding from view either of the composite pictures 23 or 25, and showing a composite picture on either side of the slats 34. Thus, two additional pictures are produced by the device.

What I now claim is:

1. An illuminated picture frame, displaying a plurality of pictures, comprising, in combination, a rectangular frame around a central opening, a box behind said opening being open on its front side to said opening, a slotted, stationary, first grate in said box, a first picture on a front side of a rear wall of said box, a second and a third picture carried by said first grate, said first grate comprising a row of equally spaced-apart, equal width, flat slats positioned at right angles to said rear wall, said second picture comprising a plurality of picture sections on a left side of said slats, while said third picture comprises a plurality of picture sections on a right side of said slats; a slotted, slidable, second grate comprising a plurality of equally spaced-apart, equal width, flat slats, slidable adjacent either said left or right sides of said first grate slats, and cover respectively either said second or third picture, and a fourth and fifth picture carried by said second grate, said fourth picture comprising a plurality of picture sections on a left side of said second grate slats, while said fifth picture comprises a plurality of picture sections on a right side of said second grate slats; and fluorescent lamp means carried on said frame for illumination of said pictures.

* * * * *